United States Patent [19]

Offner

[11] Patent Number: 5,067,537

[45] Date of Patent: Nov. 26, 1991

[54] FIXTURE FOR HINGE MORTISE

[76] Inventor: Dennis Offner, Lake Iosco, Haskell, N.J. 07420

[21] Appl. No.: 431,074

[22] Filed: Nov. 3, 1989

[51] Int. Cl.[5] ..... B27M 3/00

[52] U.S. Cl. ..... 144/372; 33/197; 144/27; 144/371; 144/144.5 R

[58] Field of Search ..... 144/27, 82, 83, 84, 144/144.5, 371, 372; 33/197

[56] References Cited

U.S. PATENT DOCUMENTS

| | | | |
|---|---|---|---|
| 464,867 | 7/1981 | Harris . | |
| 1,005,336 | 10/1911 | Sherwood . | |
| 1,326,583 | 12/1919 | Catalanotto . | |
| 1,388,223 | 8/1921 | Wakefield . | |
| 1,524,234 | 1/1925 | Carter | 144/27 |
| 1,679,074 | 7/1928 | Carter | 144/27 |
| 2,651,847 | 9/1953 | Sacrey . | |
| 2,733,518 | 2/1956 | Pszegon . | |
| 2,804,106 | 8/1957 | DiManno . | |
| 3,158,186 | 11/1964 | Heathington . | |
| 3,407,853 | 10/1968 | Bailey . | |
| 3,509,923 | 5/1970 | Bailey . | |
| 3,559,704 | 2/1971 | Thompson | 144/27 |
| 4,445,277 | 5/1984 | Keefe | 144/144.5 |
| 4,815,215 | 3/1989 | Saylor . | |

*Primary Examiner*—W. Donald Bray
*Attorney, Agent, or Firm*—Thomas L. Adams

[57] ABSTRACT

A fixture is used to cut a mortise in a workpiece for a hinge or lock strike plate by employing a pair of spaced saddles. The fixture includes at least one bar connected between the pair of saddles. At least one of the saddles is slide-ably mounted on this bar. Also included is a pair of clamps, each being mounted in a different corresponding one of the saddles to clamp the workpiece. The fixture is used by clamping the saddles on an edge of the door or jamb with the guide bar spanning the saddles. A mortise is routed into the door or jamb using the saddles as a template.

29 Claims, 3 Drawing Sheets

12
12A
12B
12C
10
10A
10B
10C
14
16
18
20
22
24
26
28
30
32
34
36
38
40
42
44
46
48
68
J
70
D

FIG. 4
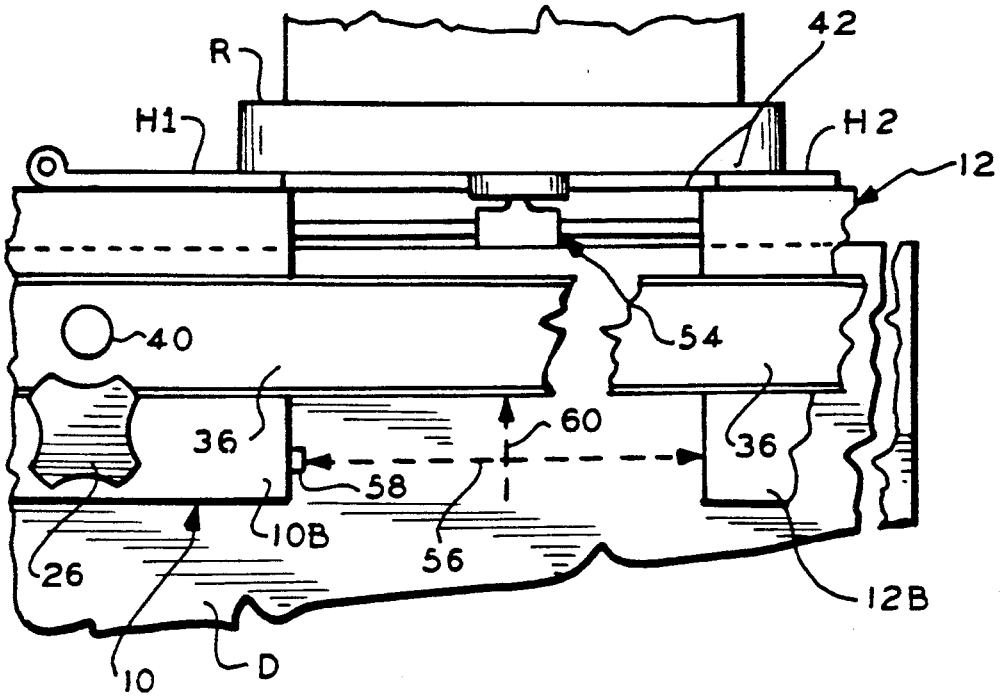
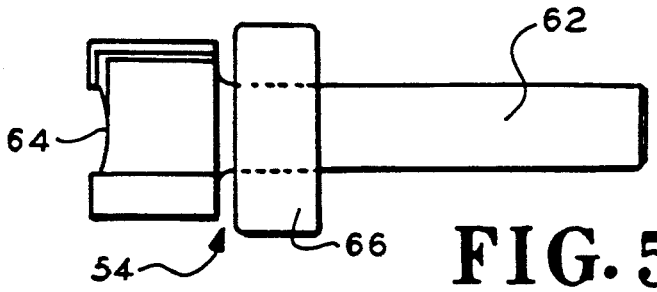
FIG. 5
FIG. 6
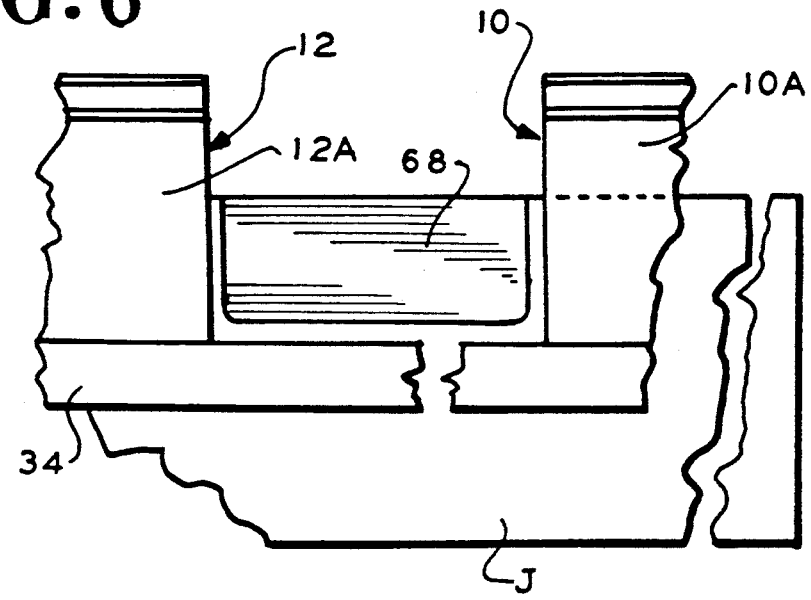

FIXTURE FOR HINGE MORTISE

BACKGROUND OF THE INVENTION

The present invention relates to fixtures for cutting hinge mortises and, in particular, to an adjustable device that can be clamped onto a door or jamb.

Mounting a door on a jamb with hinges is a highly skilled carpentry task. Accurate positioning of the hinges is necessary to insure the door will swing freely and close accurately. Conventional hinges are recessed into mortises that must be carefully and accurately cut into the inside edge of a door and at matching positions on the door jamb.

Known templates can be nailed to the door or the jamb, to be used as a guide for either a chisel or router. A disadvantage with such templates is their lack of range of adjustability and the marring of the door or jamb with nail holes. Furthermore, known templates are either dedicated to cutting a mortise on either the door or the jamb.

For example, U.S. Pat. Nos. 3,158,186 and 4,815,215 show router guides for cutting a mortise. However, these known device do not have the flexibility to allow cutting of mortises in a simple and accurate manner. Other examples of devices used for such work can be found in U.S. Pat. Nos. 464,867; 1,005,336; 1,326,583; 1,388,223; 2,651,847; 2,733,518; 2,804,106; 3,407,853; and 3,509,923.

Accordingly, there is a need for a simple, inexpensive, adaptable, and accurate device for facilitating cutting a mortise for a hinge or lock strike plate in a workpiece such as a door or jamb.

SUMMARY OF THE INVENTION

In accordance with the illustrative embodiments demonstrating features and advantages of the present invention, there is provided a fixture for cutting a mortise for a hinge or strike plate in a workpiece with a pair of spaced saddles. The fixture includes a pair of clamp means and at least one bar connected between the pair of saddles. At least one of the saddles is slideably mounted on the bar. Each of the clamp means is mounted in a different corresponding one of the saddles to clamp the workpiece.

A related method according to the principles of the present invention employs a pair of saddles and a guide for a making in a door or jamb a mortise for a hinge or strike plate. The method includes the step of clamping the saddles on an edge of the door or jamb with the guide spanning the saddles. Another step is routing a mortise into the door or jamb using the saddles as a template.

By using the foregoing fixture and method an improved system is achieved for cutting a mortise in a workpiece such as a door or jamb. A preferred fixture employs a pair of saddles having an arch and two walls arranged in a "U" shape. This preferred arrangement includes a clamp threaded through one wall in each of the saddles to hold edgewise between the walls, a door or jamb.

Preferably, guide bars fit into grooves, tracks or ridges at three locations on the saddles. In the preferred embodiment, two of the guide bars are fixed to one saddle, but slideably mounted in the other saddle. Preferably, these two guide bars are on opposite walls of the saddle to give dimensional stability one of them can be releasably secured from sliding in the sliding saddle with a thumb set screw.

Preferably, one of the guide bars is mounted on its saddle walls to act as part of three-sided template for routing past the walls into a jamb. In this preferred embodiment, however, another guide is removable to avoid interference when a jamb is being cut. With this guide removed, the side of a jamb is accessible by a router, so that a mortise can be cut without interference from the removable guide. This removable guide can be slid into a corner of each of the saddles for cutting a mortise in a door. When a door mortise is being cut, the removable guide is in place to form one side of a three-sided template, to guide a router working on the edge of a door.

In this preferred embodiment, the adjustability between the saddles is facilitated by longitudinally extending gauging devices. Thus a hinge can be placed between the saddles which are then brought together until the gauging devices abut the hinge, thereby automatically setting the proper saddle-to-saddle spacing. Also provided, is an adjustable gauge set in the arch of each saddle to protrude through the arch an adjustable amount. This gauge can engage the edge of a jamb to keep it at a fixed spacing.

By using such apparatus and methods, a carpenter can rapidly set the fixture on a door or a jamb and quickly rout a mortise without marring the surface of the door or jamb.

BRIEF DESCRIPTION OF THE DRAWINGS

The above brief description as well as other objects, features and advantages of the present invention will be more fully appreciated by reference to the following detailed description of presently preferred, but nonetheless illustrative embodiments in accordance with the present invention when taken in conjunction with the accompanying drawings wherein:

FIG. 4 is a detailed view of the fixture of FIG. 2 being set up for the proper router cutting depth;

FIG. 5 is a side view of the router bit of FIG. 4;

FIG. 6 is a detailed view of the fixture along lines 6—6 of FIG. 3;

DETAILED DESCRIPTION OF THE PREFERRED EMBODIMENTS

Figures 1, 7, 8:
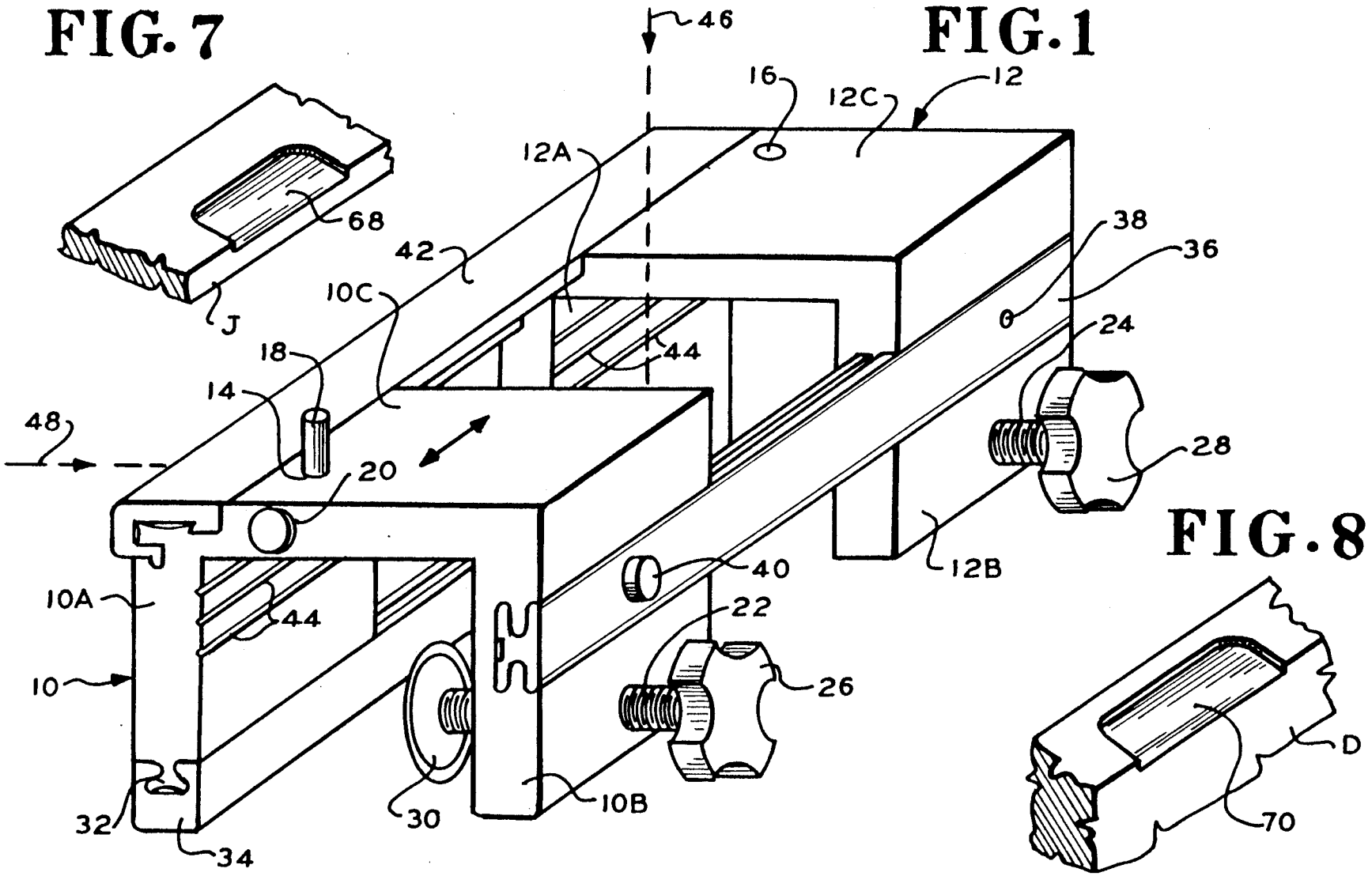
FIG. 1 is a perspective view of a fixture in accordance with the principles of the present invention.
FIG. 7 is a perspective view of a mortise cut in a jamb.
FIG. 8 is a perspective view of a mortise cut in a door.

Referring to FIG. 1, it shows a fixture including saddles 10 and 12. Saddles 10 and 12 are shown with a "U" shape formed from right and left walls 10A, 10B, 12A and 12B and an arches 10C and 12C. Arches 10C and 12C have stop holes 14 and 16, respectively. A stop 18 is shown fitted in stop hole 14 to protrude through both sides of arch 10C. A similar stop (not shown) can be inserted in hole 16. Stop 18 is shown secured by thumb set screw 20 (a similar thumb set screw being associated with hole 16). Saddles 10 and 12 are shown as extrusions identical except for the placement of stop holes 14 and 16. In other embodiments something other than extrusions can be used and the saddles may be composed of a number of discrete parts that are fastened together by appropriate means.

A pair of clamping means is shown herein including threaded rods 22 and 24 which are threaded into threaded holes in walls 10B and 12B, respectively. The outside ends of rods 22 and 24 have handles 26 and 28, respectively, for turning the rods. The inside end of rod 22 has a clamping disk 30. A similar disk (not shown) being fitted onto rod 24. The outer edges of walls 10A and 12A have a T-shaped railing, one such rail being shown herein as rail 32. Rail 32 fits into a complementary T-shaped groove in guide bar 34. Guide bar 34 is another extrusion having a generally rectangular cross section with rounded outside corners and a T-shaped groove matching rail 32. Rail 32 and guide 34 are shown relieved to allow free sliding of the guide. As shown in further detail hereinafter, there is a set screw through the bottom of guide bar 34 that locks onto the bottom of wall 12A to keep elements 12A and 34 spatially fixed.

Another guide bar is shown herein as slide 36 which has an H-shaped cross section that is relieved to provide easy sliding within the complementary track in the center of the outside of walls 10B and 12B. Guide bar 36 is fixed to wall 12B by set screw 38. Consequently, saddle 10 can slide along guide bars 36 and 34. Such sliding motion can be arrested by turning down thumb set screw 40 which acts as a set means.

Bar 42 is shown as a removable guide having a ?-shaped cross section. This shape effectively produces a dovetail joint with saddles 10 and 12. In a preferred embodiment, bar 42 is an extrusion which is shaped to engage the complementary dovetail track located at the corners of saddles 10 and 12 (specifically, the juncture of wall 10A and arch 10C and the juncture wall 12A and arch 12C). It will be noted that the track into which guide 42 fits is relieved so that there is little chance for binding. Also, the dovetailing of guide 42 pulls the top surface into alignment to allow door cuts without interference.

Three graduations 44 are engraved on the inside of walls 10A and 12A. Graduations 44 are marks used to position a jamb within saddle 10 and 12 and is used in connection with stop 18 in the manner to be described presently. The opening along line 46 is bordered by guide 42 and arches 10C and 12C, the latter three elements forming a door mortising template. The opening along line 48 is bordered by bar 34 and walls 10A and 12A, the latter three elements forming a jamb mortising template.

Figure 2:
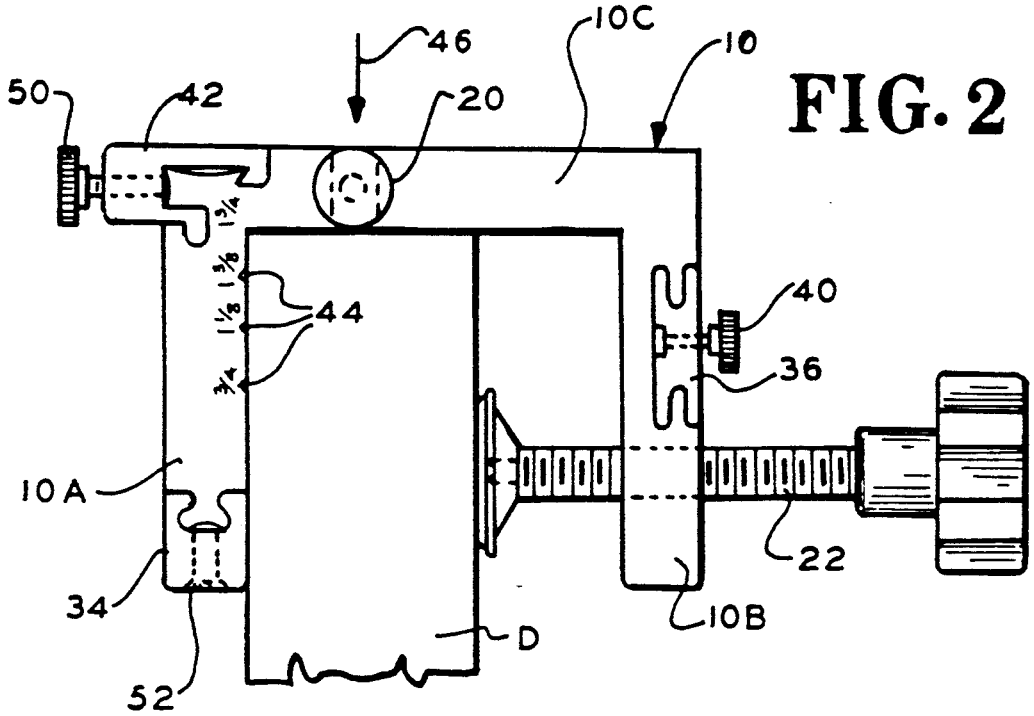
FIG. 2 is an end view of the fixture of FIG. 1 shown clamped to a door.

Referring to FIG. 2, a door D is shown clamped by clamp means 22 against the wall 10A. In this view, removable guide 42 is shown releasably secured to saddle 10 with a thumb set screw 50, which acts as a release means. By loosening thumb screw 50, guide 42 can be removed. A set screw 52 is shown securing bar 34 to previously mentioned wall 12A, but leaving wall 10A free to slide on bar 34 and 36 until thumb set screw 40 is turned down.

Figure 3:
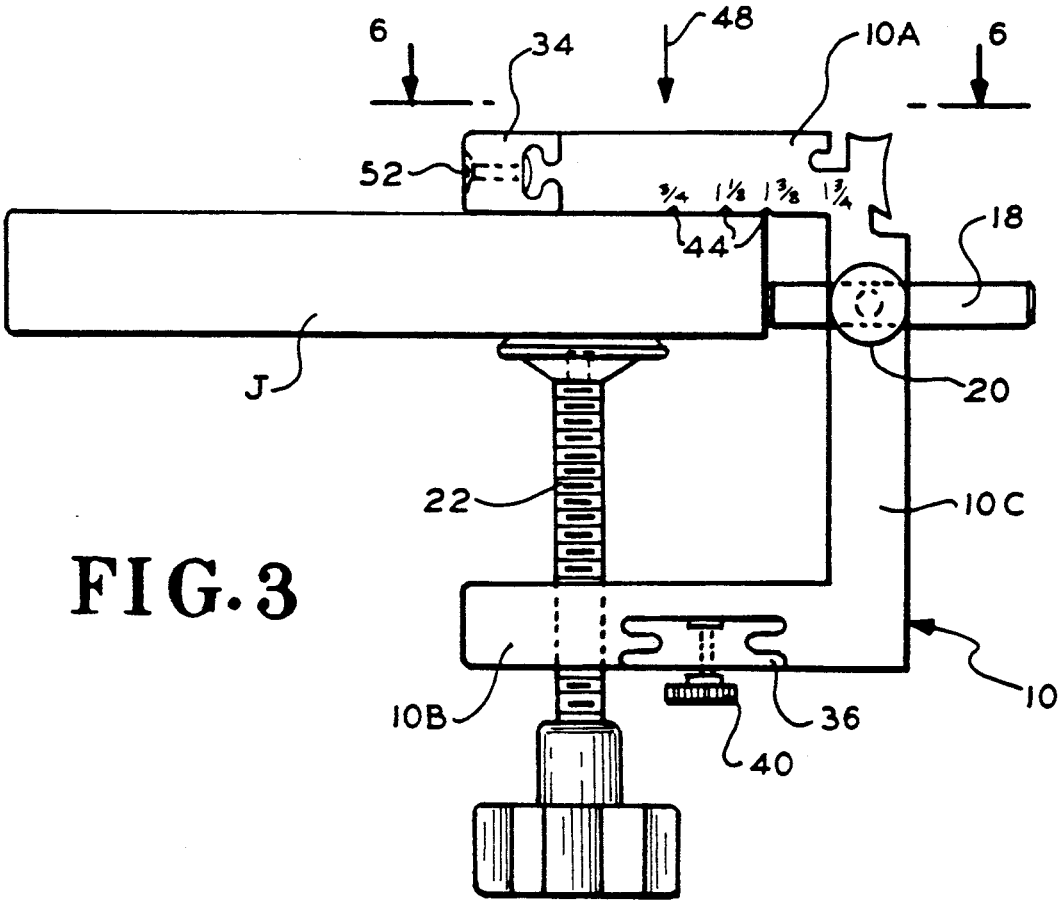
FIG. 3 is an end view of the fixture of FIG. 1 shown clamped to a door jamb.

Referring to FIG. 3, a door jamb J is shown held by clamp 22 against the inside surface of wall 10A. (It will be appreciated that the clamp associated with saddle 12 will operate in a equivalent manner.) The stop 18 has been adjusted using thumb screw 20 to establish the spacing of jamb J from arch 10C. Setting of stop 18 is facilitated by graduations 44. Graduations 44 are identified by the illustrated marks engraved on the end of wall 10A to indicate the door thickness. It is important to note that the previously mentioned removable guide is no longer at the juncture of wall 10A and wall 10C. Consequently, the opening along line 48 of the jamb template has essentially only three elements defining the template, there being no guide at the right edge (this view) of jamb J. Thus the template of FIG. 3 is a three-sided template.

Referring to FIG. 4, previously illustrated saddles 10 and 12 are shown clamped to door D. A router is shown with its downwardly extending bit 54 set to just touch the inside edge of door D. The base of router R is shown resting on hinges H1 and H2, placed atop saddles 10 and 12. Being set in this fashion, when hinges H1 and H2 are removed, router 54 will cut to a depth equal to the thickness of hinges H1 and H2. Also, the spacing between saddles 10 and 12 can be set by placing a hinge along line 56. The length of line 56 is affected by projection 58 so that the saddle-to-saddle spacing around router bit 54 is somewhat greater than the length of the hinges. This feature accounts for the difference in diameter between the cutting portion of the bit and the roller which will be described presently. Advantageously, the hinge can be placed along line 56 with its free edge inside the groove, indicated by arrow 60, in the edge of guide 36 to facilitate ease of adjustment.

Referring to FIG. 5, previously mentioned router bit 54 is shown with a shank 62 supporting bit end 64 which performs the routing. Rotatably mounted on shank 62 is a roller 66 used to guide the bit 54. The outside diameter of roller 66 exceeds the cutting diameter of router bit 64. The roller to cutter spacing is chosen so that the roller keeps full contact with the guide bars and saddles when cutting at a typical depth.

Referring to FIG. 6, jamb J is shown clamped within saddles 10 and 12 so that a jamb template is formed by bar 34 and walls 10A and 12A. Arranged in this fashion, a mortise 68 can be formed in jamb J. As before hinges can be used to set the depth of the router bit. Since there is no removable guide on saddles 10 and 12, there is no restriction on the side of mortise 68 opposite bar 34. This mortise 68 is shown in greater detail in FIG. 7. The complementary mortise 70 is shown cut in the inside edge of door D in FIG. 8.

In operation, the fixture of FIG. 1 can be used to reproduce rapidly mortises in a door or a jamb. For door mortises, the hinge is initially inserted into the groove of bar 36 (FIG. 4) between walls 10B and 12B, abutting against projection 58. The saddle 10 is adjusted longitudinally and then set in place by thumb screw 40. The removable guide 42 is kept in place.

Thereafter, saddles 10 and 12 are simply clamped to the door and the mortise is cut using removable guide 42 and saddles 10 and 12 as guides. The fixture of FIG. 1 can be rapidly repositioned along the door edge simply by loosening handles 26 and 28 and repositioning the fixture. Thus mortises can be quickly reproduced.

When the carpenter now wishes to cut jamb mortises, he or she simply loosens thumb screw 50 (FIG. 2) and removes guide 42. Next the stop 18 is adjusted in holes 14 and 16, using graduations 44 to match the appropriate door thickness. The graduations 44 are marked to indicate the thickness of the door being used. After being set up in this fashion, the fixture of FIG. 1 can be quickly clamped to a jamb using handles 26 and 28. Thereafter, a jamb is mortised using the jamb template formed by walls 10A and 12A and bar 34. When the next jamb mortise is to be cut, the carpenter need only loosen handles 26 and 28, reposition the fixture of FIG. 1 and after clamping, simply cut the next jamb mortise.

It is to be appreciated that various modifications may be implemented with respect to the above described preferred embodiments. The various bars and guides shown in FIG. 1 can be alter to have other cross sections including "T" shapes, "C" shapes and other cross sections. In addition, the amount of relief provided for each bar can be altered. While set screws are used for securing various devices, in some embodiments the elements may be affixed by being pinned together. Furthermore, the dimensions of the saddles can be changed depending upon the expected sizes of the doors and jambs to be mortised. Also, while three bars and guides are shown, in alternate embodiments a different number may be employed. In addition, while the major components are extrusions, in other embodiments these components may be molded, machined or fabricated in alternate manners.

Obviously, many modifications and variations of the present invention are possible in light of the above teachings. It is therefore to be understood that within the scope of the appended claims, the invention may be practiced otherwise than as specifically described.

What is claimed is:

1. A fixture for cutting a mortise for a hinge or strike plate in a workpiece comprising:

a pair of spaced saddles;

at least one bar connected between said pair of saddles, at least one of said saddles being slideably mounted on said bar;

a pair of clamp means, each being mounted in a different corresponding one of said saddles to clamp said workpiece; and a removeable guide detachably mounted between said saddles.

2. A fixture according to claim 1 wherein each of said saddles includes:

two walls; and an arch spanning said walls, said removeable guide being positioned on said saddles near the juncture of said arch with one of said walls, said removeable guide and said arch of said saddles defining three sides of a door template.

3. A fixture according to claim 2, wherein said bar is mounted parallel to and distal from said removeable guide, said saddles and said bar defining three sides of a jamb template.

4. A fixture according to claim 3 further comprising:

an adjustable stop mounted in said arch of at least one of said saddles for keeping said workpiece at an adjustable distance from said door template.

5. A fixture according to claim 4 comprising:

a slide mounted between said saddles on that one of said walls of each of the saddles distal from said removeable guide.

6. A fixture according to claim 5 wherein said slide comprises:

set means for releaseably securing said slide to one of said saddles, the other one being fixed to said slide.

7. A fixture according to claim 6 wherein said removeable guide comprises:

release means for releasably securing said guide to one of said saddles.

8. A fixture according to claim 7 wherein each of said clamp means comprises:

a threaded rod threadably mounted in on of the walls of each of the saddles;

an handle mounted on the outside end of said rod for turning it; and a disk mounted on the inside end of said rod for holding said workpiece edgewise in each of said saddles.

9. A fixture according to claim 8 wherein each of said saddles has a stop hole, said adjustable stop including a pair of members, each being mounted to protrude into said saddle an adjustable amount.

10. A fixture according to claim 9 wherein at least one of said saddles has on the inside of one of said walls a plurality of graduations parallel to said bar.

11. A fixture according to claim 10 wherein said bar has a T-shaped groove, said saddle having a relieved ridge fitted into said T-shaped groove.

12. A fixture according to claim 11 wherein said removeable guide has a ? -shaped cross-section, each of said saddles has at the juncture of said arch and one of said walls a relieved track shaped to engage said removeable guide in a dovetail joint.

13. A fixture according to claim 12 wherein said slide has an "H" shaped cross-section, that one of said walls of each of the saddles distal from said removeable guide having a relieved and "H" shaped slot for engaging said slide.

14. A fixture according to claim 1 wherein said pair of clamp means are operable to hold said workpiece edgewise in each of said saddles, said fixture further comprising:

an adjustable stop mounted in at least one of said saddles for keeping an edge of said workpiece at an adjustable distance from said saddles.

15. A fixture according to claim 1 comprising:

a slide mounted between said saddles at a position that is spaced from and parallel to said removeable guide.

16. A fixture according to claim 15 wherein said slide comprises:

set means for releasably securing said slide to one of said saddles, the other one being fixed to said slide.

17. A fixture according to claim 1 wherein said bar has a T-shaped groove, said saddle having a relieved ridge fitted into said T-shaped groove.

18. A fixture according to claim 1 further comprising:

a removeable guide detachably mounted between said saddles and having a ? -shaped cross-section, each of said saddles having a relieved track shaped to engage said removeable guide in a dovetail joint.

19. A fixture according to claim 1 further comprising:

a slide mounted between said saddles and having an "H" shaped cross-section sized to receive an edge of said hinge or strike plate, each of the saddles having a relieved and "H" shaped slot for engaging said slide.

20. A fixture according to claim 19 wherein one of said saddles has extending toward the other:

a projection for engaging one edge of said hinge or strike plate and setting the distance between said saddles.

21. A method employing a pair of saddles and a guide for making in a door or jamb a mortise for a hinge or strike plate, comprising the steps of:

clamping said saddles on an edge of said door or jamb, said clamping being done while said guide is positioned upon and secured to said saddles to span them;

routing a mortise into said door or jamb using said saddles as a template, in said step of routing said saddles and said guide being used as a template.

22. A method according to claim 21 employing a bar connected between said saddles, comprising the step of:

removing said guide from said saddles, said step of routing being performed using said bar and said saddles as a template.

23. A method according to claim 21 comprising the step of:

placing said hinge or strike plate between said saddles to separate them at least by the length of said hinge or strike plate.

24. A method according to claim 23 employing a router and comprising the step of:

placing the hinge or strike plate upon at least one of said saddles;

positioning said router upon said hinge or strike plate and adjusting its cutting depth to just reach said door or jamb.

25. A method according to claim 21 wherein said step of routing is performed with said door and wherein said saddles are clamped on the edge of said door to rout said mortise in said edge.

26. A method according to claim 21 wherein said step of routing is performed with said jamb and wherein said saddles are clamped on the edge of said jamb to rout sidewardly between said saddles in the face of said jamb.

27. A method according to claim 26 employing a stop, comprising the step of:

inserting said stop between the edge of said jamb and said saddle to set the spacing therebetween.

28. A fixture for cutting a mortise for a hinge or strike plate in a workpiece comprising:

a pair of spaced saddles;

at least one bar connected between said pair of saddles, at least one of said saddles being slideably mounted on said bar;

a pair of clamp mans, each being mounted in a different corresponding one of said saddles to clamp said workpiece, said bar having a T-shaped groove, said saddle having a relieved ridge fitted into said T-shaped groove.

29. A fixture for cutting a mortise for a hinge or strike plate in a workpiece comprising:

a pair of spaced saddles;

at least one bar connected between said pair of saddles, at least one of said saddles being slideably mounted on said bar;

a pair of clamp means, each being mounted in a different corresponding one of said saddles to clamp said workpiece; and a slide mounted between said saddles and having an "H" shaped cross-section sized to receive an edge of said hinge or strike plate, each of the saddles having a relieved and "H" shaped slot for engaging said slide.

* * * * *